US007969299B2

(12) United States Patent
Hupp et al.

(10) Patent No.: US 7,969,299 B2
(45) Date of Patent: Jun. 28, 2011

(54) METHOD FOR MONITORING A GROUP OF OBJECTS AND ASSOCIATED ARRANGEMENT

(75) Inventors: Jürgen Hupp, Nürnberg (DE); Volker Gehrmann, Erlangen (DE); Alexander Pflaum, Erlangen (DE)

(73) Assignee: Fraunhofer-Gesellschaft zur Förderung der Angewandten Forschung E.V., München (DE)

( * ) Notice: Subject to any disclaimer, the term of this patent is extended or adjusted under 35 U.S.C. 154(b) by 572 days.

(21) Appl. No.: 11/883,014

(22) PCT Filed: Jan. 25, 2006

(86) PCT No.: PCT/EP2006/000641

§ 371 (c)(1),
(2), (4) Date: May 9, 2008

(87) PCT Pub. No.: WO2006/079520

PCT Pub. Date: Aug. 3, 2006

(65) Prior Publication Data

US 2008/0238657 A1 Oct. 2, 2008

(30) Foreign Application Priority Data

Jan. 25, 2005 (DE) ..... 10 2005 003 502
Apr. 23, 2005 (DE) ..... 10 2005 019 064

(51) Int. Cl.
*G08B 1/08* (2006.01)

(52) U.S. Cl. ..... 340/539.1; 340/539.23; 340/531; 340/573.1; 340/10.1; 340/10.41; 340/870.07; 340/568.2; 370/254; 370/310; 370/331; 370/345; 455/423

(58) Field of Classification Search ..... 340/539.1, 340/539.23, 531, 573.1, 10.1, 10.41, 870.07, 340/568.2; 370/254, 310, 331, 345; 455/423
See application file for complete search history.

(56) References Cited

U.S. PATENT DOCUMENTS

| | | | | |
|---|---|---|---|---|
| 5,844,900 | A * | 12/1998 | Hong et al. | 370/342 |
| 7,430,186 | B1 * | 9/2008 | Kim | 370/328 |
| 2003/0063585 | A1 * | 4/2003 | Younis et al. | 370/331 |
| 2003/0151513 | A1 | 8/2003 | Herrmann et al. | |
| 2004/0005889 | A1 * | 1/2004 | Nishimura et al. | 455/423 |

(Continued)

FOREIGN PATENT DOCUMENTS

EP 1 406 207 A1 4/2004

OTHER PUBLICATIONS

International Search Report dated May 4, 2006 issued in PCT/EP2006/000641.

(Continued)

*Primary Examiner* — George A Bugg
*Assistant Examiner* — Sisay Yacob
(74) *Attorney, Agent, or Firm* — Venable LLP; Robert Kinberg; Christopher Ma

(57) ABSTRACT

A method for monitoring a group of objects, and an arrangement to implement the method includes providing each object of the group to be monitored with a radio node of a self-networking radio network, whereby each radio node within the group has a unique identification. The radio nodes of the group automatically reveal themselves at a starting time and network with one another. The radio nodes of the group monitor themselves from the starting time and convey at least one specified change in an initial mutual situation. At least one of the radio nodes when notifying or recognizing a specified change, conveys information concerning the change to a monitoring unit and/or controls an alarm transmitter for activating an alarm.

15 Claims, 1 Drawing Sheet

U.S. PATENT DOCUMENTS

| | | | | |
|---|---|---|---|---|
| 2004/0246104 | A1 | 12/2004 | Baechtiger et al. | |
| 2005/0057370 | A1 * | 3/2005 | Warrior et al. | 340/870.01 |

OTHER PUBLICATIONS

German Office Action dated Dec. 5, 2005 issued in DE 10 2005 019 064.2.

Raphael Hahn, Oliver Neukum: Sensornetzwerke. In: Hauptseminar ' Dienste & Infrastrukturen mobiler Systeme Wintersemester 03/04, Institut für Informatik Ludwig Maximilians Universität München. http://www.mobile.ifi.lmu.de/Hauptseminare/ws0304/DIMS/Ausarbeitung Hahn Neukum.pdf.

* cited by examiner

METHOD FOR MONITORING A GROUP OF OBJECTS AND ASSOCIATED ARRANGEMENT

TECHNICAL APPLICATION FIELD

The present invention relates to a method for monitoring a group of objects, particularly, bundled products and an arrangement formed by the implementation of the method.

The monitoring of objects plays an important role in many fields. Thus, a strong demand exists, for example, for procedures for protecting and tracing goods in logistical networks. Expensive goods such as electronic products, for example, disappear in large quantities on the way from the manufacturing plant to the sales outlets. Companies report that products in transit are replaced by worthless articles and the theft is only discovered when unpacking the products at the place of destination. In Great Britain, for example, more than 900,000 mobile phones annually are stolen on the way from the production facility to the sales points.

PRIOR ART

To date no reliable solutions are known to the Applicant with which such thefts can be prevented to a sufficient extent. The use of the increasingly prevailing radio-frequency identification (RFID) technology also does not offer any reliable solution. The monitoring of goods with this technology is in principle only possible in the spatially restricted reading area of the RFID base stations. A constant monitoring from the production facility to the points of sale can hardly be realized. Further, there is no guarantee with the use of the RFID technology due to the insufficient penetration of the RFID technology that all products in a bundle and/or on a pallet are actually covered.

With the existing RFID technology, manipulations of product packaging can at most be recognized. The product packaging is provided for this purpose with conductive strips and sensors, microchip and energy storage. With the help of electronics, for example, a wrongful opening can be recognized and electronically documented on the packaging. Moreover, within the context of the first research and development projects, pallets and repackaging with RFID were equipped with labels and vehicles with readers as well as with positioning and mobile communication technology to monitor road transportation. RFID-technology was also used at interfaces between the companies in field tests to monitor the delivery processes.

SUMMARY OF THE INVENTION

An object of the present invention comprises providing a method for monitoring a group of objects, the method can detect and notify promptly and independently a location from which individual objects of the group are removed. The method in this connection should be particularly suitable for the monitoring of products packaged in bundles.

In one embodiment of the method for monitoring a group of objects according to the invention, each of the objects of the group to be monitored is provided with a radio node of a self-networking radio network or objects with a radio node of a self-networking radio network are assembled to form a group, wherein each radio node within the group has a unique identification, selecting itself or receives a unique identification, within the group. In the method, the radio nodes of the group automatically reveal themselves at a starting time, respectively, a period of reference and network with one another. The radio nodes are formed such that they monitor themselves from the starting time and notify each other of at least one specified change in the mutual situation, whereby at least one of the radio nodes when notifying or recognizing such a specified change conveys information about the change to a monitoring unit and/or controls an alarm transmitter for activating an alarm.

The specified change in the mutual situation which the radio nodes recognize and convey, concerns preferably the removal of an object from the group. This can be recognized by the breaking off of the radio contact to this radio node or a weakening of the radio connection under a specifiable threshold value given in advance by the neighboring radio nodes before in radio range. The radio range of the individual radio nodes is thereby selected, of course, to be so small. That is, the distance is selected according to the distance of the individual objects within the group so that a removal of an object out of the group can be detected. Thus, it concerns a radio network with which the radio nodes can communicate only in short distances with each other. The radio range has to be sufficiently large on the other side in order to enable the radio communication of neighboring radio nodes to form the radio network.

In the present invention, therefore, radio nodes are used which mutually recognize each other, network with one another and monitor. The system formed of radio nodes is thereby able to recognize autonomously changes in the structure of the group, for example, the removal of an object from a bundle of individual objects and to actively react, for example, by activating an alarm. The system used in the method and/or the arrangement of a plurality of objects resulting from the method has a plurality of distributed active radio nodes which are attached to or are in the objects to be monitored. The radio nodes can be attached thereby on the packaging of products of a bundle, for example, a pallet. Each radio node involved has a unique identification which is either assigned to it or is selected by itself in coordination with the other radio nodes of the system. Preferably, one or more gateway nodes per group are also integrated in the radio network, over which information from the radio network is conveyed to another system and/or can be fed from the outside into the radio network. Instead of separate gateway nodes, the gateway function can also be realized as part of each individual radio node. In this connection, a respectively suitable radio node then takes over the connection to the other system, respectively, network in order to communicate with the monitoring unit. This other network can be, for example, a WLAN or a GSM network. The gateway node or the radio nodes equipped with the gateway function for this purpose must be able to build up a longer reaching connection (in contrast to the short range connection with other radio nodes).

Instead of the gateway node or the gateway functionality of the radio nodes—or in addition thereto—one or more alarm transmitters can also be integrated in the radio network which can be controlled by the radio nodes for activating an alarm, for example, an optical and/or acoustic alarm signal.

The individual radio nodes in the present method and in the associated arrangement have a transmission unit, a control unit as well as a network management function as functional units. The transmission unit represents a sender and receiving unit for the delivery and receipt of radio signals and provides wireless communication with other radio nodes. The radio range of the radio nodes must reach at least neighbouring radio nodes. Otherwise no topology is specified.

The network management function, as it is used in self-networking radio networks, serves the recognition of neighboring and/or directly and indirectly attainable radio nodes and can also be a component of the control unit. The control unit, preferably a microprocessor, serves the monitoring of the respective neighboring, respectively, attainable radio nodes and is preferably configured for the time and event-controlled start of recognizing, processing, reporting and/or other transmission procedures.

Self networking radio networks with such radio nodes are known from other fields, in particular, the field of distributed sensor networks. As standardized, low current transmission protocol, for example, Zigbee or TinyOS of the University of California, Berkeley, can be used. Of course, other network protocols, however, are suitable for transmission within the radio network.

Preferably, one, several or all radio nodes of the radio network of the group have sensors for the recognition of manipulations on the individual objects or are connected with such sensors. These sensors can, for example, be configured such that they recognize the opening of a packing. In the present method, specified manipulations detected by the sensor systems are at least conveyed by the respective radio nodes to the other radio nodes, whereby at least one of the radio nodes when notifying or recognizing a specified manipulation conveys information concerning the manipulation to a monitoring unit and/or controls an alarm transmitter for activating an alarm. In this design, therefore, manipulations and the theft of objects are detected rapidly and event-controlled almost all over and notified, respectively, reported, for example, by activating an alarm siren on a bundle or an alarm in the control center. In this way a manipulation or a theft can be reacted to without delay. The specific manipulations detected with sensor systems can concern all manipulations which can be detected with the respective sensor or also only such manipulations in which a value detected by the sensor surpasses or falls short of a specific threshold which can be given in advance.

In a further design of the present method as well as the associated arrangement, one or a plurality of sensors for monitoring specific properties of objects can also be connected with the radio nodes, respectively, or integrated in the radio nodes. Properties recognized by the sensor systems are also conveyed here to the respective other radio nodes, wherein at least one of the radio nodes transmits the conveyed or recognized properties to a monitoring unit and/or controls an alarm transmitter to activate an alarm by the excess or short fall of one or more threshold values which can be given in advance to one or more properties. The control unit of the radio nodes in this connection can also be configured such that the communication to the respective other radio nodes or the transmission to the monitoring unit occurs only by the excess or short fall of one or more definable threshold values. The detection of properties can occur once or many times during the use of the radio nodes on the objects. Thus, gas sensors on gas bottles as objects to be monitored, for example, monitor the gas composition in the bottles. For refrigerated products, for example, temperature sensors are used to monitor the temperature of the objects. Further, the environment conditions, for example, the storage temperature of a warehouse in which the objects are stored, can also be detected and conveyed on to the monitoring unit.

In addition to the monitoring of the objects from a distance to individual objects, the individual radio nodes can also recognize and communicate to the other radio nodes their relative position to the other radio nodes by evaluating network information, neighboring relationships, and the level of the receiver signals or suchlike. In this way, the position of the individual objects within the group of objects can be detected and used in order to locate more quickly, for example, specific objects in the group. In another form a radio node or also a gateway node can comprise a localization system for determining the absolute position, for example, by means of GPS. The absolute position determined with the localization system in this connection is preferably repeatedly transmitted to the monitoring unit. Thereby, the position of the group of objects by transport, for example, is known at any time or at least can be called up.

The present method uses a self-organizing and/or self-networking radio network with arbitrary topology for monitoring the objects of a group of objects, for example, for detecting and signalling manipulations of products and/or packaging, or the removal of goods or packed goods out of larger bundles. In a further design of the present method, objects are already equipped at production with appropriate radio nodes. In a further step of the execution of the method, the bundle of individual objects is then assembled. Subsequently, the objects on the pallet are instructed to network with each other and thereby to recognize the structure of the bundle. This can occur, for example, via a coded command by radio. The system is then switched to continuous operation. If a sensor event is activated, for example, by packaging manipulation or if a radio node is removed from the radio network, and/or an object is removed from the bundle, then this is detected to the network. This information is distributed in the network via the radio nodes and reported by the gateway node to the outside and/or signalled by the alarm unit.

The present method and the associated arrangement have the advantage compared to the use of the RFID technology that they are not bound by the spatially limited range of a read out station since active radio nodes within the radio network are used. The read security of the system is considerably increased by the tightly woven network of radio nodes since the individual nodes do not communicate directly with a distant reading station but communicate via multi-hop method and redundant routing paths. With the use of a local alarm unit, for example, an alarm siren on a pallet with objects, a superordinated communication infrastructure is not necessarily required. Through the network and intelligence of the radio nodes can also application-based objectives can be assumed and processed in network autonomously, cooperatively or are delegated. The method and the associated arrangement enable not only just the recognition of theft or the manipulation of objects. Rather, the method and the arrangement also enable the continuous and subsequent high spatial pursuit of objects, for example, of goods in logistical networks.

BRIEF DESCRIPTION OF THE DRAWINGS

The present method and the arrangement resulting therefrom are briefly explained again in the following on the basis of an exemplary embodiment in connection with the drawings. Shown in the figures.

DETAILED DESCRIPTION

Figure 1:
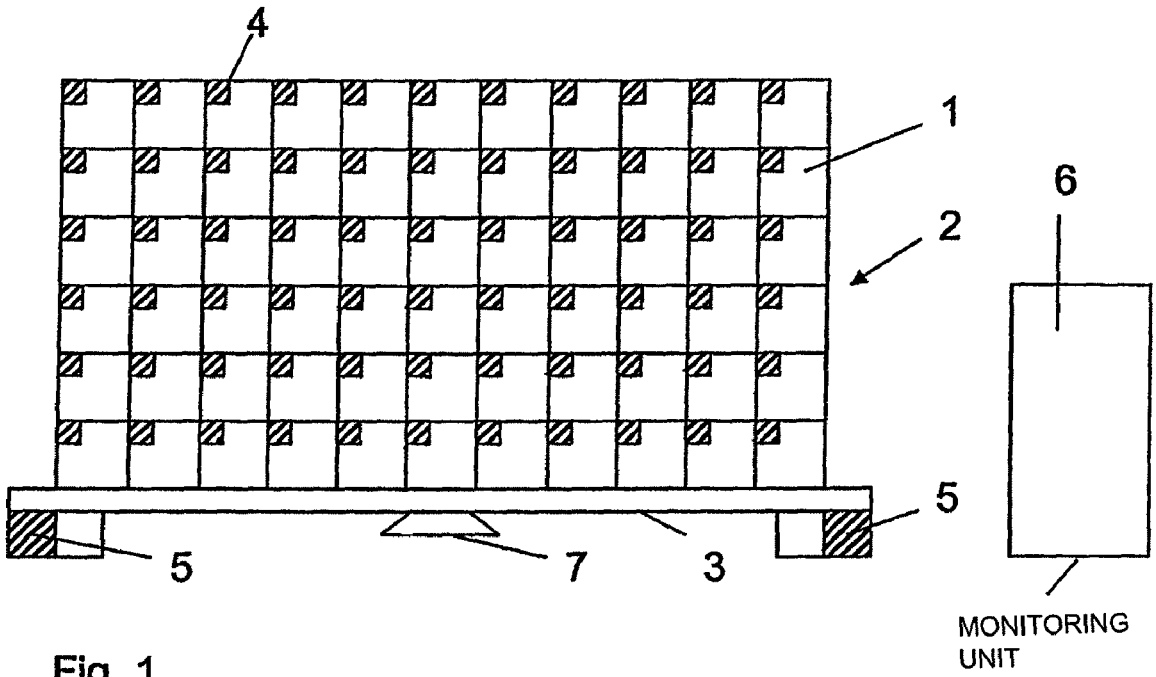
FIG. 1 an example for a group of objects which are equipped with radio nodes according to the present method.

An embodiment of the present method is described in the following on the basis of a distribution chain for mobile telephones. The service provider maintains a central distribution warehouse for mobile phones and undertakes the distribution of the devices over several intermediary stages into the shops of the company. During the distribution logistics process the danger exists that individual products (mobile telephones) may disappear from pallets, that telephones can be stolen out of the packaging and that at the end of the distribution chain complete packages may disappear on the way to the post office.

This danger should be reduced through the use of this present method. For this purpose both the product packaging 1 of the mobile telephones as well as larger packaging units, in the present example, pallet 3, are equipped with radio nodes 4 which have additional sensors 8 for a manipulation of the packaging 1. The same technology can also be used of course in the same manner for post parcels as larger packaging units instead of the pallets.

The radio nodes 4 for the packaging 1 are preferably realized in the chip card format and are attached inside of the packaging. They have the possibility to detect a beam of light by means of sensors, to communicate with their neighbours over short distances and to self-network. For communication in the present example a radio range of less than 1 meter is sufficient since the individual packaging 1 within group 2, to which it is combined on the pallet 3, lie close together and also the packaging 1 itself is small. Further, at least one gateway node 5 is attached to pallet 3, respectively, to the postal parcel, which from the design may be somewhat larger than the radio node 4 on the packaging 1. The gateway node 5 can communicate with the smaller radio nodes 4 as well as with other gateway nodes 5 and an external sender/receiver unit, the latter, for example, over WLAN or GSM. An external sender/receiver unit is located in the present example in a central monitoring unit 6 in the warehouse.

In the gateway nodes 5 additional algorithms for position determination can be implemented with which also the absolute position of the node can be determined, for example, via GPS. Further, an alarm siren 7 is also located in the present example on the pallet 3 which can be activated by radio both over the radio nodes 4 as well as over the gateway nodes 5 for the delivery of an alarm signal.

Figure 2:
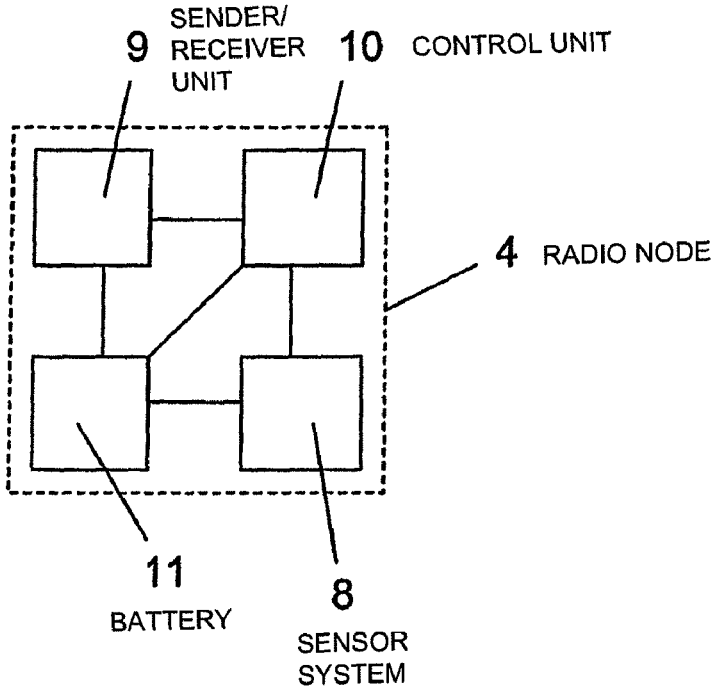
FIG. 2 an example for the structure of a radio node in schematic representation.

FIG. 2 shows, for example, the structure of a radio node 4 in the present method. The radio nodes 4 have a sender and receiver unit 9 for communication with neighboring nodes as well as a control unit 10, in which the active functions of the radio nodes are run and/or activated. This control unit 10 comprises a microprocessor and the corresponding software for carrying out the functions, for example, network management, monitoring of neighboring radio nodes and the recognition and transmission of sensor data.

For the operation of the radio nodes a battery 11 is provided which also takes over the supply of the sensor system 8 used in this example. This sensor system 8 is designed in the present example to detect a light beam within the packaging 1, thus, a product manipulation, and with other applications can also comprise sensors to recognize additional data, for example, the temperature of the products. A gateway node 5 can principally be configured in the same way, whereby the sender and receiver unit 9, however, for larger range connections must be suitable. Further, a gateway node 5 can have additionally a localization system for determining the absolute position.

At the end of the production process radio nodes 4 are removed from a pool by the manufacturer or by the logistic service company and are introduced into the product packaging 1. The product packaging 1 are subsequently stacked on pallet 3 or are packed in a package. During the process, at least one gateway node 5 is integrated additionally. After the pallet formation or packaging is completed, the radio nodes 4 are switched on and are networked with each other and with the gateway node 5. This can occur by a radio signal sent to the radio nodes, for example, which the radio nodes recognize as start signal for the networking. For this purpose, a suitable control program is implemented in the control unit 10. After this starting point in the present example, each individual radio node 4 checks in defined, short intervals of a few seconds whether all neighbours recognized at the starting time are still in the range. If, for example, up to the loading in a truck a package is removed without approval, the security network is torn. The theft will be recognized by the neighbour of the radio node of this product packaging, since the former can no longer be reached. Corresponding information is transmitted over the remaining radio network, i.e. the remaining radio nodes 4, to the gateway node 5 and from there relayed to the central monitoring unit 6 in the warehouse. Simultaneously, an alarm can also be activated to the alarm 7. The localization algorithm in the gateway node 5 can be used for this purpose in order to determine the absolute position of the pallet concerned and/or the package with relative accuracy. A security agent can identify the thief via cameras with the help of this information and with a large probability even catch him in the act.

In the same manner, the radio nodes recognize over the integrated sensor for detecting a light beam if a package 1 is opened without approval. In this case, a similar process is triggered wherein the radio nodes 4 concerned transmit the information about the product manipulation over the radio network to the gateway node 5, which in turn sends this information to the monitoring unit 6. In this case, too, an alarm signal can be activated at the same time via the alarm siren 7.

With an appropriate radio connection, for example, via GSM, a theft or a product manipulation can be notified to an appropriate monitoring station at any time which does not have to be in the direct surroundings of the pallet concerned, respectively, the package concerned. Through the possibility of the absolute position determination of the pallet over an integrated localization system can at any time the momentary location of the pallet be determined within the distribution chain in order to initiate appropriate measures.

For further commissioning procedures in the process run can the security network be switched off by authorized persons or also automatically in order to avoid false alarms.

Through the use of the present method and the resulting arrangement therefrom, thefts can be effectively prevented without disrupting the distribution process. The radio, nodes can additionally support this distribution process since the input controls and scanning processes could be eliminated. At the destination, the radio nodes, for example, at the point of sale terminal of a store, are removed from the product packaging and are reintroduced to the pool.

The present method can be used not only for the distribution of objects but also for the monitoring of any group of objects whose mutual change in position and/or their manipulation is supposed to be recognized.

The invention claimed is:

1. A method for monitoring a group of objects, comprising:

providing each object to be monitored with a radio node of a self-networking radio network;

assembling a plurality of the objects provided with the radio nodes together to form the group, whereby each radio node within the group has a unique identification assigned to it, or receives a unique identification selected in coordination with the other radio nodes of the radio network;

automatically revealing individual radio nodes of the group at a starting time so that the plurality of radio nodes network with one another and initialize a mutual spatial position of the objects within the group;

monitoring the individual radio nodes of the group from the starting time to detect a change in the mutual spatial position and conveying at least one specified change in the mutual spatial position from at least one radio node that recognizes the change to another radio node; and conveying information concerning the change from the at least one of said radio nodes to one of a monitoring unit or an alarm transmitter for activating an alarm.

2. The method according to claim 1, wherein the specified change represents a removal of a radio node from the radio network.

3. The method according to claim 1, wherein the radio node of at least one object includes a sensor system, the method further comprising:

recognizing a specified manipulation of the at least one object by the sensor system;

notifying another radio node of the group when the specified manipulation of the at least one object is recognized; and when recognizing or notifying the specified manipulation, conveying information by at least one of the radio nodes concerning the specified manipulation to one of the monitoring unit or to the alarm transmitter to activate the alarm.

4. The method according to claim 1, wherein the radio node of at least one object includes a sensor system, the method further comprising:

recognizing with the sensor system a property of the at least one object or of an environment of the at least one object;

notifying another radio node of the radio network at least one time after the starting time of the recognized property;

conveying the recognized property from at least one of the radio nodes to the monitoring unit to determine a value of the recognized property; and controlling the alarm transmitter in dependence of a whether the value of the recognized property exceeds or shortfalls a threshold value.

5. The method according to claim 1, the method further comprising:

conveying the mutual spatial position of the objects to the monitoring unit by at least one of the radio nodes.

6. The method according to claim 1, wherein the radio network includes an integrated gateway node that communicates with the radio nodes and the monitoring unit, the conveying step comprising communicating the change to the monitoring unit via the gateway node.

7. The method according to claim 6, wherein at least one of the radio nodes or the gateway node comprises a localization system for determining an absolute position, the method further comprising conveying the absolute position determined by the at least one radio node or gateway node to the monitoring unit.

8. The method according to claim 1, wherein the group of objects are products in a bundle.

9. An arrangement, comprising:

a plurality of objects arranged in a group;

at least one of a monitoring unit or an alarm transmitter; and a self-networking radio network comprising a plurality or radio nodes each of which is arranged with a respective one of the objects, wherein each radio node has a unique identification, and each radio node includes a control unit operative so that the radio nodes mutually monitor each other and communicate a change in a mutual spatial position of the radio nodes, and wherein at least one of the radio nodes conveys information about the change to at least one of the monitoring unit or the alarm transmitter to activate an alarm.

10. The arrangement according to claim 9, wherein the radio node of at least one of the objects includes a sensor system coupled to the control unit and being operative to recognize a manipulation of the at least one object, wherein the control unit of the at least one object is operative to notify the manipulation to at least one other radio node of the network, and wherein at least one of the radio nodes of the network conveys information about the manipulation to at least one of the monitoring unit or the alarm transmitter.

11. The arrangement according to claim 9, wherein the radio node of at least one of the objects includes a sensor system coupled to the control unit and being operative to recognize at least one property of the object or an environment of the object, wherein the control unit of the at least one object is operative to notify at least one other radio node of the network of the recognized property and wherein at least one of the radio nodes of the network conveys information about the property to the monitoring unit, the monitoring unit being operative to control the alarm transmitter in dependence of whether a value of the recognized property exceeds or short falls a threshold value.

12. The arrangement according to claim 9, wherein the radio network includes at least one integrated gateway node through which information is transmitted from the radio network or fed into the radio network.

13. The arrangement according to claim 12, wherein at least one radio node or gateway node comprises a localization system to determine absolute position and convey the determined position to the monitoring unit.

14. The arrangement according to claim 9, wherein the plurality of objects are products in a bundle.

15. The method according to claim 1, wherein the mutual spatial position comprises relative positions of the objects within the group.

* * * * *